US006025314A

United States Patent [19]

Nitsch et al.

[11] Patent Number: 6,025,314

[45] Date of Patent: Feb. 15, 2000

[54] CLEAR-RINSING AGENTS WITH CATIONIC POLYMERS

[75] Inventors: Christian Nitsch, Duesseldorf; Willi Buchmeier, Mettmann; Peter Jeschke, Neuss; Ludwig Schieferstein, Ratingen; Herbert Fischer, Duesseldorf, all of Germany

[73] Assignee: Henkel Kommanditgesellschaft auf Aktien, Duesseldorf, Germany

[21] Appl. No.: 09/029,776

[22] PCT Filed: Aug. 23, 1996

[86] PCT No.: PCT/EP96/03724

§ 371 Date: May 6, 1998

§ 102(e) Date: May 6, 1998

[87] PCT Pub. No.: WO97/09408

PCT Pub. Date: Mar. 13, 1997

[30] Foreign Application Priority Data

Sep. 4, 1995 [DE] Germany ..... 195 32 542

[51] Int. Cl.[7] ..... C11D 3/37

[52] U.S. Cl. ..... 510/221; 510/475; 510/514

[58] Field of Search ..... 510/433, 475, 510/514, 221

[56] References Cited

U.S. PATENT DOCUMENTS

| | | | |
|---|---|---|---|
| 4,101,456 | 7/1978 | Renaud et al. | 252/551 |
| 4,454,060 | 6/1984 | Lai et al. | 252/547 |
| 5,374,716 | 12/1994 | Biermann et al. | 536/18.6 |
| 5,576,425 | 11/1996 | Hill et al. | 536/18.6 |

FOREIGN PATENT DOCUMENTS

| | | |
|---|---|---|
| 0077588 | 4/1983 | European Pat. Off. . |
| 0167382 | 1/1986 | European Pat. Off. . |
| 0301298 | 2/1989 | European Pat. Off. . |
| 0342997 | 11/1989 | European Pat. Off. . |
| 0467472 | 1/1992 | European Pat. Off. . |
| 560519 A2 | 9/1993 | European Pat. Off. . |
| 2616404 | 10/1976 | Germany . |
| 4131898 A1 | 9/1991 | Germany . |
| 4301459 A1 | 7/1994 | Germany . |
| 4318171 | 12/1994 | Germany . |
| 6-288871 | 8/1994 | Japan . |
| 90/03977 | 4/1990 | WIPO . |

OTHER PUBLICATIONS

Tens. Surf. Det. 28: 313–319 (1991).

*Primary Examiner*—Yogendra Gupta
*Assistant Examiner*—John R. Hardee
*Attorney, Agent, or Firm*—Ernest G. Szoke; Wayne C. Jaeschke; Glenn E. J. Murphy

[57] ABSTRACT

A process for improving the soil release properties of dishwashing machine rinse aid compositions used to rinse dishware and remove starch-containing soils therefrom by adding to the compositions a cationic polymer containing monomer units corresponding to formula I:

(I)

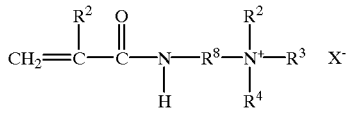

in which $R^1$ is hydrogen or a methyl group, $R^2$, $R^3$ and $R^4$ are the same or different and represent hydrogen or a $C_{1-8}$ alk(en)yl group, $R^8$ is a linear, cyclic or branched alkylene group containing 2 to 8 carbon atoms, and X represents a monofunctional anion or the 1/m part of an m-functional anion.

3 Claims, No Drawings

CLEAR-RINSING AGENTS WITH CATIONIC POLYMERS

BACKGROUND OF THE INVENTION

1. Field of the Invention

This invention relates to the use of cationic polymers as soil release compounds in rinse aids for dishwashing machines.

Commercial rinse aids for dishwashing machines are mixtures of low-foaming fatty alcohol polyethylene/polypropylene glycol ethers, solubilizers (for example cumene sulfonate), organic acids (for example citric acid) and solvents (for example ethanol). The function of these rinse aids is to influence the surface tension of the water in such a way that the water is able to drain off the dishes in the form of a thin coherent film so that no droplets of water, streaks or films are left behind after the subsequent drying process. An overview of the composition of rinse aids and methods for testing their performance was published by W. Schirmer et al. in Tens. Surf. Det. 28, 313 (1991).

In machine dishwashing, it occasionally happens that firmly adhering soils such as, for example, oat flakes and starch deposits are not completely removed during the cleaning process.

2. Discussion of Related Art

It is known from EP-A-0 167 382, EP-A-0 342 997 and DE-OS 26 16 404 that cationic polymers can be added to dishwashing detergents to obtain streak-free cleaning of the surfaces.

EP-A-0 167 382 describes liquid detergent compositions which may contain cationic polymers as thickeners. Hydroxypropyl trimethyl ammonium guar, copolymers of aminoethyl methacrylate and acrylamide and copolymers of dimethyl diallyl ammonium chloride and acrylamide are described as particularly suitable cationic polymers.

EP-A-0 342 997 describes multipurpose cleaners which may contain cationic polymers, more particularly polymers containing imino groups.

DE-OS 26 16 404 describes glass cleaners containing cationic cellulose derivatives. The addition of the cationic cellulose derivatives improves drainage of the water so that no streaks are left behind on the cleaned glass.

EP-A-0 467 472 describes hard surface cleaners containing cationic homopolymers and/or copolymers as so-called soil release polymers. These polymers contain quaternized ammonium alkyl methacrylate groups as monomer units. These compounds are used to finish the surfaces in such a way that the soils are easier to remove the next time the surfaces are cleaned.

The documents cited above disclose the use of cationic polymers in cleaning formulations. There is nothing in any of these documents to indicate how it is possible in machine dishwashing to facilitate the removal of obstinate soils, for example starch-containing soils.

The problem addressed by the present invention was to provide a rinse aid which would enable firmly adhering soils, such as oat flakes and other starch deposits, to be readily removed from the dishes in subsequent cleaning cycles.

DESCRIPTION OF THE INVENTION

The present invention relates to the use of cationic polymers selected from cationic polymers of copolymers of monomers, such as trialkyl ammonium alkyl (meth)acrylate or acrylamide; dialkyl diallyl diammonium salts; polymer-analog reaction products of ethers or esters of polysaccharides containing ammonium side groups, more particularly guar, cellulose and starch derivatives; polyadducts of ethylene oxide containing ammonium groups; quaternary ethylene imine polymers and polyesters and polyamides containing quaternary side groups as soil release compounds in rinse aids for dishwashing machines.

It has surprisingly been found that, if soil release compounds are added to the rinse aid in machine dishwashing, firmly adhering and often critical soils, for example starch-containing soils, can be completely removed in the next dishwashing cycle. These soils can be removed without any need for additional manual cleaning of the dishes.

Suitable cationic polymers are, in particular, water-soluble homopolymers or copolymers containing monomer units corresponding to formula I:

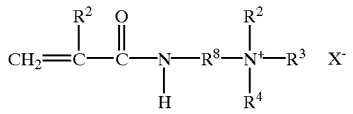

(I)

in which $R^1$ is hydrogen or a methyl group and $R^2$, $R^3$ and $R^4$ may be the same or different and represent hydrogen or a $C_{1-8}$ alk(en)yl group, $R^8$ is a linear, cyclic or branched alkylene group containing 2 to 8 carbon atoms and X represents a monofunctional anion or the 1/m part of an m-functional anion.

Other suitable polymers are those which contain monomer units corresponding to formula II:

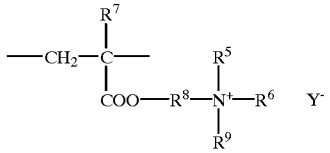

(II)

in which $R^5$ to $R^7$ and $R^9$ represent lower $C_{1-4}$ alkyl groups, $R^8$ is an alkylene group containing 2 to 8 carbon atoms and Y is a monofunctional anion or the 1/n part of an n-functional anion, as described in European patent application 467 472.

The anions in formulae I and II may be, for example, halide ions, such as chloride or bromide, $SO_4^{2-}$ or $CH_3SO_4^-$.

The polymers preferably used may contain 40 mole-% to 100 mole-% of the monomer units corresponding to formula I or II. The percentage of monomer units corresponding to formula I should preferably be no lower than 40 mole-% because otherwise the polymers would not have sufficient solubility in water. Besides the monomer units corresponding to formula I, unsaturated monocarboxylic acids, such as acrylic acid, methacrylic acid, crotonic acid and the like, olefins, such as ethylene, propylene and butene, alkyl esters of unsaturated carboxylic acids, such as methyl acrylate, ethyl acrylate, methyl methacrylate, hydroxy derivatives thereof, such as 2-hydroxyethyl methacrylate, unsaturated aromatic compounds, such as styrene, methyl styrene, vinyl styrene, and heterocyclic compounds, such as vinyl pyrrolidone, may be used as comonomers. Preferred comonomers are acrylic acid, methacrylic acid and vinyl pyrrolidone.

The cationic polymers described above may be used in quantities of 0.1% by weight to 30% by weight, based on the rinse aid.

The present invention also relates to rinse aids for dishwashing machines containing a) 0.1% by weight to 30% by weight of cationic polymers selected from cationic polymers of copolymers of monomers, such as trialkyl ammonium alkyl (meth) acrylate or acrylamide; dialkyl diallyl diammonium salts; polymer-analog reaction products of ethers or esters of polysaccharides containing ammonium side groups, more particularly guar, cellulose and starch derivatives; polyadducts of ethylene oxide containing ammonium groups; quaternary ethylene imine polymers and polyesters and polyamides containing quaternary side groups,
b) 0.5 to 30% by weight of organic carboxylic acids,
c) 0.5 to 30% by weight of nonionic surfactants selected from the group of end-capped and OH-terminated fatty alcohol polypropylene glycol/polyethylene glycol ethers, alkyl polyglycosides, $C_{6-22}$ fatty acid-N-alkyl polyhydroxyalkylamides, $C_{6-22}$ fatty acid alkanolamides, $C_{6-22}$ fatty acid-N-alkyl polyhydroxyalkyl amides, fatty alkyl amine oxides and mixtures thereof and
d) 10% by weight to 98.1% by weight of water.

Water-soluble homopolymers or copolymers containing monomer units corresponding to formula I or II are preferably used as the cationic polymers.

Suitable organic carboxylic acids are, for example, aliphatic hydroxydi- and tri-carboxylic acids, such as malic acid (monohydroxysuccinic acid), tartaric acid (dihydroxysuccinic acid); saturated aliphatic dicarboxylic acids, such as oxalic acid, malonic acid, succinic acid, glutaric acid, adipic acid, gluconic acid (hexane pentahydroxy-1-carboxylic acid), although water-free citric acid is preferably used. The carboxylic acids are preferably used in quantities of about 1 to 20% by weight.

The surfactant base of the rinse aids is preferably formed by nonionic surfactants which are preferably present in a quantity of 2 to 20% by weight. The nonionic surfactants are preferably selected from the group of mixed ethers corresponding to formula III:

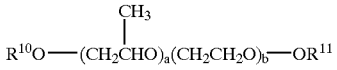

(III)

in which $R^{10}$ is a linear or branched, aliphatic alkyl and/or alkenyl group containing 8 to 14 carbon atoms, $R^{11}$ is a linear or branched alkyl group containing 1 to 4 carbon atoms or a benzyl group, a is 0 or a number of 1 to 2 and b is a number of 5 to 15, fatty alcohol polypropylene glycol/polyethylene glycol ethers corresponding to formula IV:

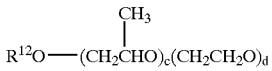

(IV)

in which $R^{12}$ is a linear or branched, aliphatic alkyl and/or alkenyl group containing 8 to 16 carbon atoms, c is 0 or a number of 1 to 3 and d is a number of 1 to 5, and alkyl polyglycosides corresponding to formula V:

(V)

in which $R^{13}$ is an alkyl group containing 8 to 22 carbon atoms, G is a sugar unit containing 5 or 6 carbon atoms, preferably a glucose unit, and p is a number of 1 to 10.

The mixed ethers corresponding to formula III are known end-capped fatty alcohol polyglycol ethers which may be obtained by relevant methods of preparative organic chemistry. Fatty alcohol polyglycol ethers are preferably reacted with alkyl halides, more particularly butyl or benzyl chloride, in the presence of bases. Typical examples are mixed ethers corresponding to formula III, in which $R^{10}$ is a technical $C_{12/14}$ cocoalkyl group, a is 0, b is a number of 5 to 10 and $R^{11}$ is a butyl group (Dehypon® LS-54 or LS-104, Henkel KGaA). The use of butyl-terminated or benzyl-terminated mixed ethers is particularly preferred for performance-related reasons.

The fatty alcohol polypropylene/polyethylene glycol ethers corresponding to formula IV are known nonionic surfactants which are obtained by addition of, first, propylene oxide and then ethylene oxide or ethylene oxide alone to fatty alcohols. Typical examples are polyglycol ethers corresponding to formula IV, in which $R^{12}$ is an alkyl group containing 12 to 18 carbon atoms, c is 0 or 1 and d is a number of 2 to 5 (Dehydol® LS-2, LS-4, LS-5, Henkel KGaA, Düsseldorf, FRG). Preferably, however, the fatty alcohols are only ethoxylated, i.e. c=0.

Alkyl polyglycosides (APG) corresponding to formula V are known substances which may be obtained by the relevant methods of preparative organic chemistry. EP-A-0 301 298 and WO 90/3977 are cited as representative of the extensive literature available on these substances.

The alkyl polyglycosides may be derived from aldoses or ketoses containing 5 or 6 carbon atoms, preferably glucose. Accordingly, preferred alkyl polyglycosides are alkyl polyglucosides.

The index p in general formula III indicates the degree of oligomerization (DP degree), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is generally a broken number. Alkyl polyglycosides with an average degree of oligomerization p of 1.1 to 3.0 are preferably used. Alkyl polyglycosides with a degree of oligomerization below 1.7 and, more particularly, between 1.2 and 1.6 are preferred from the performance point of view.

Other suitable additives are solubilizers, for example cumene sulfonate, dyes and fragrances. In one preferred embodiment, the rinse aids according to the invention are characterized by the absence of solubilizers.

The following Examples are intended to illustrate the invention without limiting it in any way.

EXAMPLES

To prepare soils, white dinner plates were immersed in a hot mix of potato starch and oat flakes, allowed to drain and dried at 80° C. The cleaning performance was visually evaluated by the iodine/starch reaction, i.e. by evaluating the blue coloration of the soil remains formed with iodine solution after cleaning.

In the dishwashing tests, clean plates were first treated with rinse aid formulations 1 to 4 identified in Table 1 (dosage: 4 ml) in the final rinse cycle of the dishwashing machine. On completion of the final rinse cycle, the plates were soiled as described above and then cleaned with a commercial dishwashing detergent (Somat® supra, a product of Henkel KGaA, Düsseldorf, FRG) in a commercial dishwashing machine.

Production of the Cationic Polymer Used 3.2 g of azo-biscyanopentanoic acid, which had been dissolved in 160 g of water in the presence of 4.3 g of 12.5% aqueous ammonia, were added to 1600 g of a 50% solution of methacrylamidopropyl trimethyl ammonium chloride in water and 1440 g of demineralized water.

The mixture was heated to 70° C. and left at that temperature for 30 minutes. It was then left to react for another hour at 80° C.

The polymer solution obtained was clear and pale yellow at room temperature and had a Brookfield viscosity of 600 mPas.

TABLE 1

| | 1 | 2 | 3 | 4 |
|---|---|---|---|---|
| $C_{12/14}$ cocofatty alcohol.5EO butyl ether[1] | 15.0 | 15.0 | — | — |
| $C_{12/14}$ cocofatty alcohol.10EO butyl ether[2] | — | — | 9.0 | 9.0 |
| $C_{12/14}$ cocofatty alcohol.4EO adduct[3] | — | — | 5.0 | 5.0 |
| Cationic polymer | 10 | — | 10 | — |
| Citric acid, water-free | 3.0 | 3.0 | 3.0 | 3.0 |
| Na cumene sulfonate | 5.0 | 7.0 | 4.0 | 7.0 |
| Perfume oil | 0.5 | 0.5 | 0.5 | 0.5 |
| Demineralized water | to 100 | to 100 | to 100 | to 100 |

[1]Dehypon ® LS-54 (a product of Henkel KGaA, Düsseldorf, FRG)
[2]Dehypon ® LS-104 (a product of Henkel KGaA, Düsseldorf, FRG)
[3]Dehydol ® LS-4 (a product of Henkel KGaA, Düsseldorf, FRG)

Cleaning performance was then evaluated on a scale of 0 to 10 where 0=no cleaning and 10=complete cleaning.

Cleaning performance was evaluated for starch and oat flakes at water temperatures of 55° C. and 65° C. The results are set out in Table 2.

TABLE 2

| | Potato starch | | Oat flakes | |
|---|---|---|---|---|
| | A | B | A | B |
| Example 1 | 8.3 | 8.2 | 7.0 | 7.0 |
| Example 2 (comparison) | 7.8 | 7.2 | 3.8 | 5 |
| Example 3 | 8.0 | 8.5 | 7.0 | 7.5 |
| Example 4 (comparison) | 7.5 | 7.0 | 4 | 4.5 |

A: 55° C., 20 g detergent, softened water
B: 65° C., 30 g detergent, hard water (14–16° dH)

The Examples clearly show that the use of the cationic polymers in rinse aids for machine dishwashing leads to an improvement in the removal of firmly adhering soils, such as oat flakes and other starch deposits.

What is claimed is:

1. A rinse aid composition for use in a dishwashing machine wherein said rinse aid composition provides improved proteinaceous soil-removing properties to soiled dishware, said composition comprising (a) 0.1% to 30% by weight of a cationic polymer containing 40–100 mole % of monomer units corresponding to formula I:

(I)

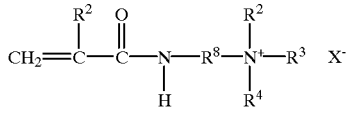

in which $R^1$ is hydrogen or a methyl group, $R^2$, $R^3$ and $R^4$ are the same or different and represent hydrogen or a $C_{1-8}$ alk(en)yl group, $R^8$ is a linear, cyclic or branched alkylene group containing 2 to 8 carbon atoms, and X represents a monofunctional anion or the 1/m part of an m-functional anion, (b) 0.5% to 30% by weight of an aliphatic di- or tricarboxylic acid, (c) 0.5% to 30% by weight of nonionic surfactants selected from the group consisting of end-capped and OH-terminated fatty alcohol polypropylene glycol/polyethylene glycol ethers, alkyl polyglycosides, $C_{6-22}$ fatty acid-N-alkyl polyhydroxyalkylamides, $C_{6-22}$ fatty acid alkanolamides, $C_{6-22}$ fatty acid-N-alkyl polyhydroxyalkyl amides, fatty alkyl amine oxides and mixtures thereof, and (d) 10% by weight to 98.1% by weight of water, based on the weight of said rinse aid composition; and (e) a solubilizer comprising cumene sulfonate or an alkali metal salt thereof.

2. A rinse aid composition as in claim 1 wherein said organic carboxylic acid comprises citric acid.

3. A rinse aid composition as in claim 1 wherein said nonionic surfactants are selected from the group corresponding to formula III:

(III)

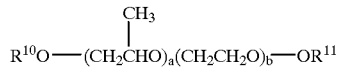

in which $R^{10}$ is a linear or branched, aliphatic alkyl or alkenyl group containing 8 to 14 carbon atoms, $R^{11}$ is a linear or branched alkyl group containing 1 to 4 carbon atoms or a benzyl group, a is 0 or a number of 1 to 2 and b is a number of 5 to 15, fatty alcohol polypropylene glycol/polyethylene glycol ethers corresponding to formula IV:

(IV)

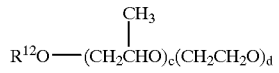

in which $R^{12}$ is a linear or branched, aliphatic alkyl or alkenyl group containing 8 to 16 carbon atoms, c is 0 or a number of 1 to 3 and d is a number of 1 to 5, and alkyl polyglycosides corresponding to formula V:

$$R^{13}O\text{-}G_p \quad (V)$$

in which $R^{13}$ is an alkyl group containing 8 to 22 carbon atoms, G is a sugar unit containing 5 or 6 carbon atoms, and p is a number of 1 to 10.

* * * * *

UNITED STATES PATENT AND TRADEMARK OFFICE

CERTIFICATE OF CORRECTION

PATENT NO. : 6,025,314
DATED : February 15, 2000
INVENTOR(S) : Nitsch et al.

It is certified that error appears in the above-identified patent and that said Letters Patent is hereby corrected as shown below:

Title page,
In the ABSTRACT and in claim 1, column 6, replace formula (I) as follows:

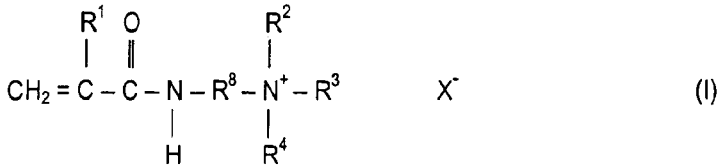

(I)

Signed and Sealed this

Twenty-first Day of October, 2003

JAMES E. ROGAN
*Director of the United States Patent and Trademark Office*